US006123031A

United States Patent [19]

Hayman-Chaffey

[11] Patent Number: 6,123,031

[45] Date of Patent: Sep. 26, 2000

[54] ADVERTISING TABLE WITH REPLACEABLE INSERT FEATURE

[75] Inventor: Charles Hayman-Chaffey, 138 E. 26th St., New York, N.Y. 10010

[73] Assignee: Charles Hayman-Chaffey, New York, N.Y.

[21] Appl. No.: 09/142,495

[22] PCT Filed: Jan. 28, 1997

[86] PCT No.: PCT/US97/01215

§ 371 Date: Jan. 15, 1999

§ 102(e) Date: Jan. 15, 1999

[87] PCT Pub. No.: WO97/32503

PCT Pub. Date: Sep. 12, 1997

Related U.S. Application Data

[60] Provisional application No. 60/013,301, Mar. 8, 1996.

[51] Int. Cl.[7] ..... A47B 17/00

[52] U.S. Cl. ..... 108/27; 108/157.1

[58] Field of Search ..... 108/27, 150, 153, 108/157.18, 158.13, 159.11, 157.1

[56] References Cited

U.S. PATENT DOCUMENTS

| | | | |
|---|---|---|---|
| 1,850,420 | 3/1932 | Schuldt . | |
| 2,044,588 | 6/1936 | Moore | 108/27 |
| 2,903,312 | 9/1959 | Lawless . | |
| 3,554,140 | 1/1971 | Homesberger . | |
| 4,293,603 | 10/1981 | Hayman-Chaffey . | |
| 4,484,754 | 11/1984 | Sleeper . | |
| 4,558,553 | 12/1985 | Kolk | 108/27 |
| 4,821,651 | 4/1989 | Peng | 108/90 |
| 4,905,611 | 3/1990 | Jung-Chung | 108/90 |
| 5,404,828 | 4/1995 | Tesney | 108/27 |
| 5,436,048 | 7/1995 | Meier et al. . | |
| 5,480,698 | 1/1996 | Hayman-Chaffey . | |
| 5,496,609 | 3/1996 | Michelstein | 108/27 X |
| 5,497,597 | 3/1996 | Elzenbeck . | |
| 5,634,411 | 6/1997 | Chasan | 108/27 X |
| 5,697,305 | 12/1997 | Chasan et al. | 108/27 X |

FOREIGN PATENT DOCUMENTS

WO 97/32503 9/1997 WIPO .

*Primary Examiner*—Jose V. Chen

*Attorney, Agent, or Firm*—Ronald P. Kananen; Rader, Fishman & Grauer

[57] ABSTRACT

In order to enable a decorative panel of a table, such as that used in fast food restaurants bars etc., to be readily interchanged in accordance with changes in season or game popularity etc., one of the moldings provided about the edge of the table is arranged to be disconnectable from the remainder of the table to expose a side edge of the decorative panel. In some embodiments, the panel is slidably received in grooves which are formed in moldings while in other embodiments the panel is adhered to the surface of the table top using dual-sided tape. When the panel is retained by way of grooves, the removal of the disconnectable molding permits the panel to be slid out and replaced. On the other hand, when the panel is secured to the table top using the dual-sided tape, removal of the removable molding exposes an edge of the panel in a manner which facilitates the application of the necessary lever action to overcome the bonding force of the tape and lift the panel up off the table in readiness for replacement with another. If desired, special lock pins which require special tools for manipulation can be used in conjunction with the panels to prevent unauthorized interchange.

17 Claims, 8 Drawing Sheets

ADVERTISING TABLE WITH REPLACEABLE INSERT FEATURE

This application claims benefit of Provisional Application Ser. No. 60/013,301 filed Mar. 8, 1996.

BACKGROUND OF THE INVENTION

1. Field of the Invention

This invention relates to a table. More specifically, this invention relates to a table having a construction which permits a decorative panel or advertising laminate, which is disposed on the upper surface of the table and which serves as the table top, to be readily and selectively interchanged with another.

2. Description of the Related Art

U.S. Pat. Nos. 5,480,698 and 4,293,603, disclose the applicants acrylic laminates and articles of furniture made from such laminates. Advertising laminates having pictured articles of advertising interest such as cola drinks, fast food pictorials and the like, were developed for depiction in such decorative laminates. The use of such laminates as a panel which part of an article, such as a drink table top is also disclosed. However, the ability to change the decorative laminate panel with another, in response to a change in season or need, is not suggested.

SUMMARY OF THE INVENTION

It is an object of this invention to provides an article of furniture, such as an advertising table, with a structure for accommodating replaceable laminated advertising inserts, so that the insert can be seasonably changed, while preserving the basic furniture structure. Thus, for example, spring advertisements could be replaced with a summer theme to be followed by a fall sports theme, to be followed by a holiday them depiction, all usable with the same basic table structure.

It is an another object of the invention to provide a table top structure which requires one edge piece or molding to be removed before the insert or decorative panel can be removed and replaced with another.

It is a further object of the present invention to provide a table to structure which enables the decorative laminate panel to be disposed in position and for the top of the panel to lie flush with the upper surfaces of the edge moldings so that the top of the table is free from upwardly extending projections which tend to catch crumbs of food and the like and prevent the top of the table from being wiped completely clean with the swipe of a cleaning cloth or the like.

It is a further object of the invention to provide a table top which features a spoiler pin construction which locks the removable edge molding in position and which requires a special tool to enable its release and subsequent removal.

In brief, the above objects are achieved an arrangement wherein one of the moldings provided about the edge of the table is arranged to be disconnectable from the remainder of the table to expose a side edge of the decorative panel. In some embodiments, the panel is slidably received in grooves which are formed in moldings while in other embodiments the panel is adhered to the surface of the table top using dual-sided tape. When the panel is retained by way of grooves, the removal of the disconnectable molding permits the panel to be slid out and replaced. On the other hand, when the panel is secured to the table top using the dual-sided tape, removal of the removable molding exposes an edge of the panel in a manner which facilitates the application of the necessary lever action to overcome the bonding force of the tape and lift the panel up off the table in readiness for replacement with another. If desired, special lock pins can be used in conjunction with the panels to prevent unauthorized interchange.

More specifically a first aspect of the invention resides in a table comprising: a table top have a recessed portion; a removable edge molding which is releasably connected to the table top; a decorative panel disposed in the recessed portion of the table top; attachment means for securing the panel in the recessed portion of the table top in a manner which requires the removable edge molding to be released and removed from the table top before the panel can be separated from an upper surface of the table top and removed from the recessed portion.

An important feature of this table resides in that the above attachment means is a slotted arrangement into which the panel can be slid, or dual-sided tape which secures the panel to an upper surface of a main member of the table.

A second aspect of the invention resides in a table wherein a decorative panel is disposed on an upper surface of a main table member; securing means secures the panel to an upper surface of a main table member, and the table includes a removable member which is detachably connected to the main table member, and which, when removed from the main table member, exposes an edge of the decorative panel in a manner which facilitates the removal and replacement of the panel with another.

BRIEF DESCRIPTION OF THE DRAWINGS

The various advantages and features of the present invention will become more clearly appreciated as a description of the preferred embodiments is given with reference to the appended drawings wherein.

DETAILED DESCRIPTION OF THE PREFERRED EMBODIMENT

Figure 1:
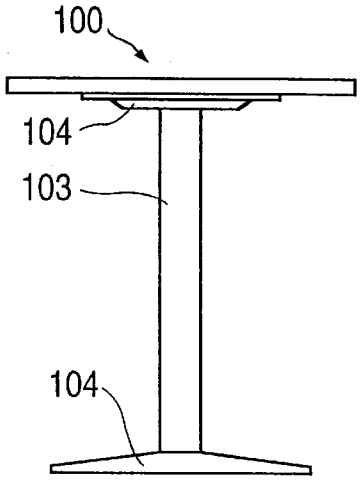
FIG. 1 is a side view of a table which exemplifies the type to which the embodiments present invention are applied.

FIG. 1 shows a table of the nature to which the embodiments of the present invention are applied. In this instance the table is of the single column or pillar type and has a table top 100, a base 102 and a pillar 103 which is connected to the lower surface of the table top 100 by way of a bracket 104.

Figure 2:
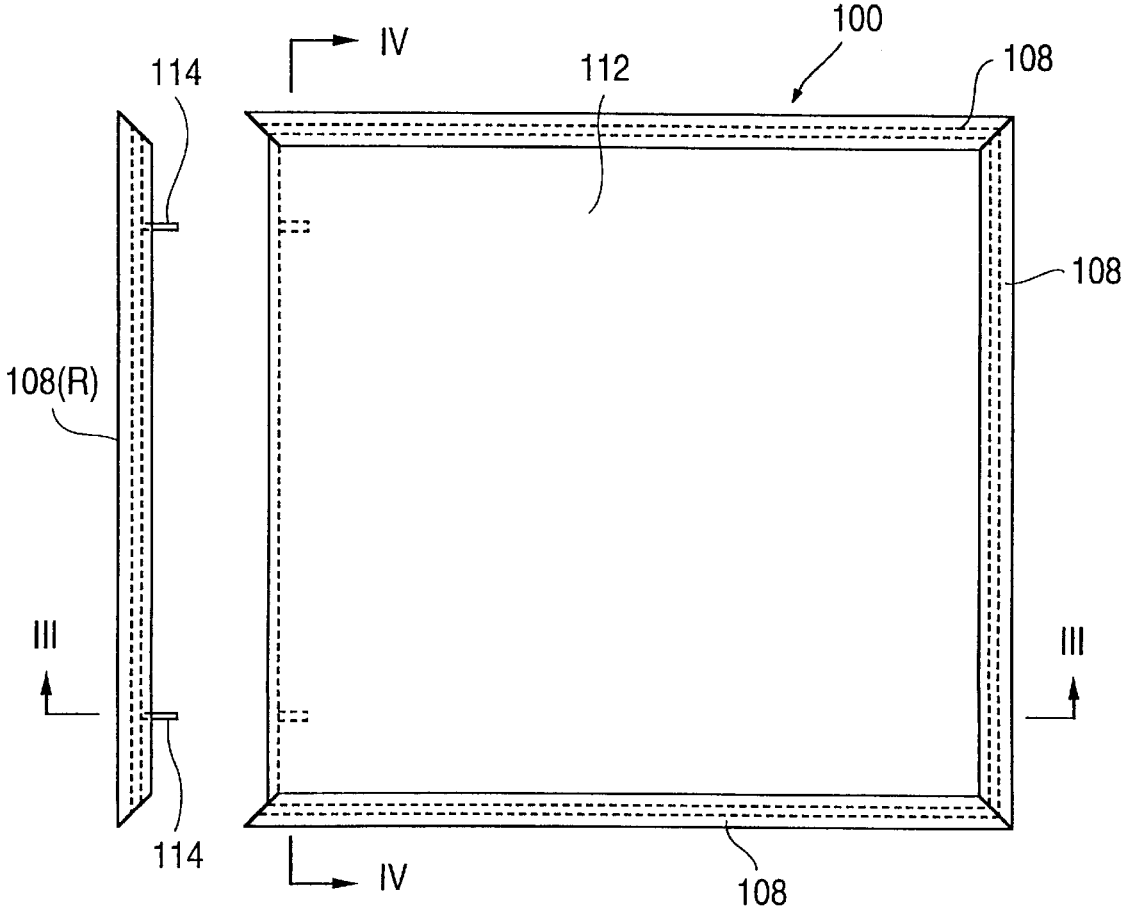
FIG. 2 is a partially exploded top plan view of a framing for an insert which is, in accordance with the first embodiment, is used as a tabletop.
Figure 3:
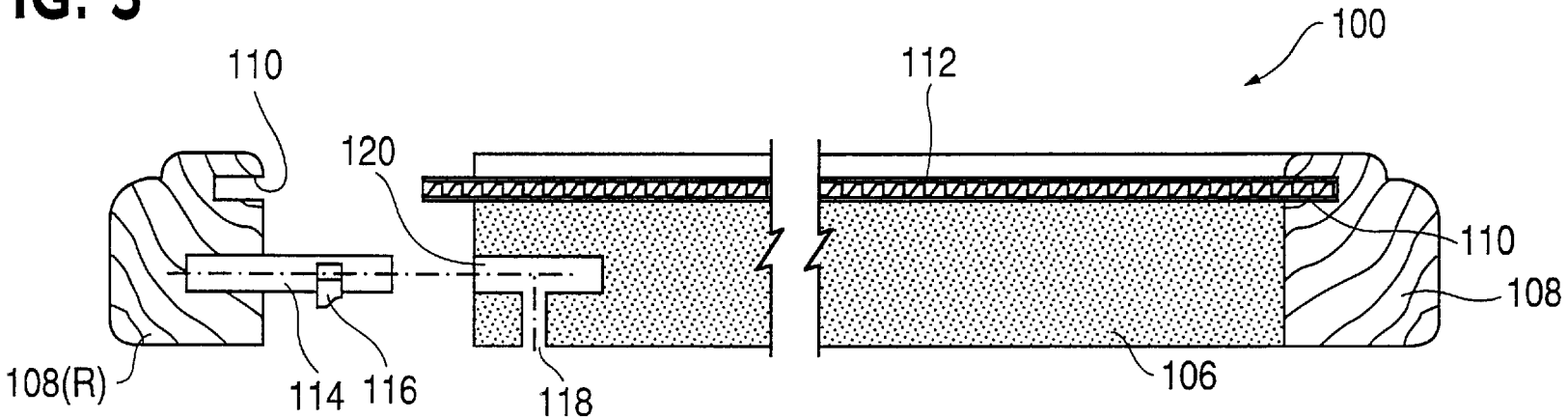
FIG. 3 is a cross-sectional view taken along section line III—III of FIG. 1.
Figure 4:
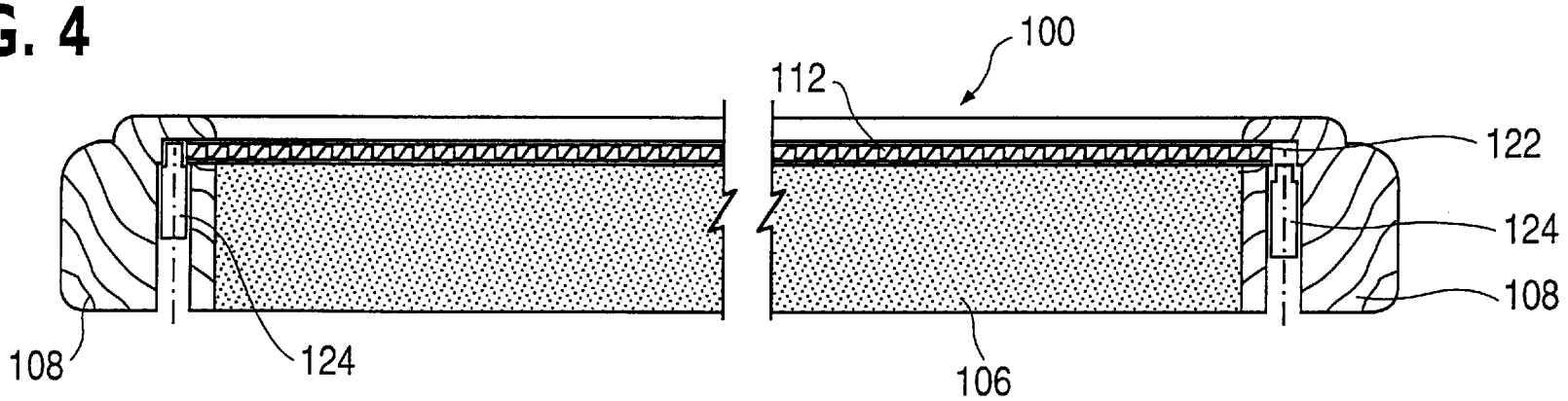
FIG. 4 is a cross-section view taken along line IV—IV of FIG. 1.
Figure 5:
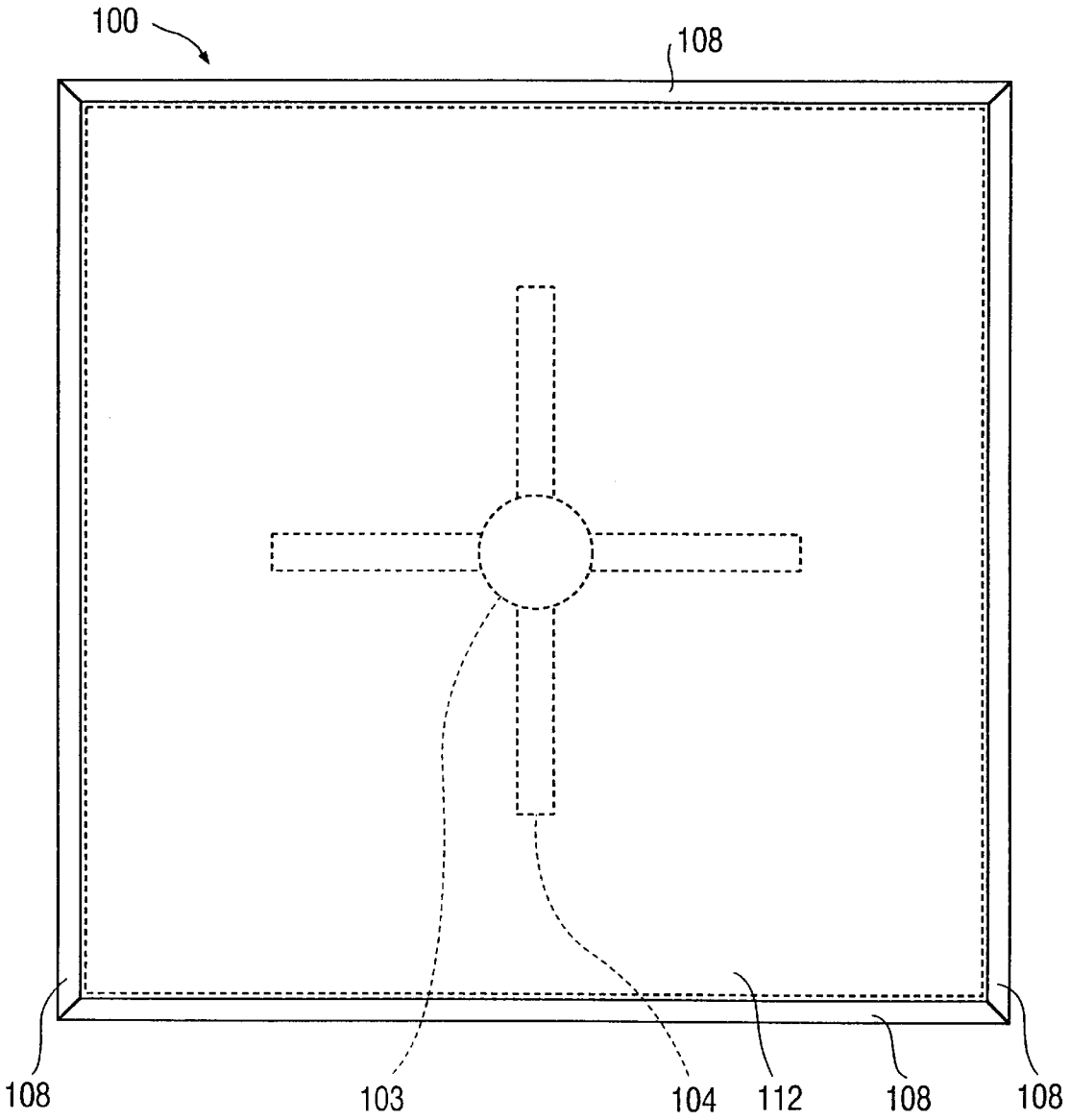
FIG. 5 is a top plan view of a table to which a second embodiment of the invention is applied.
Figure 6:
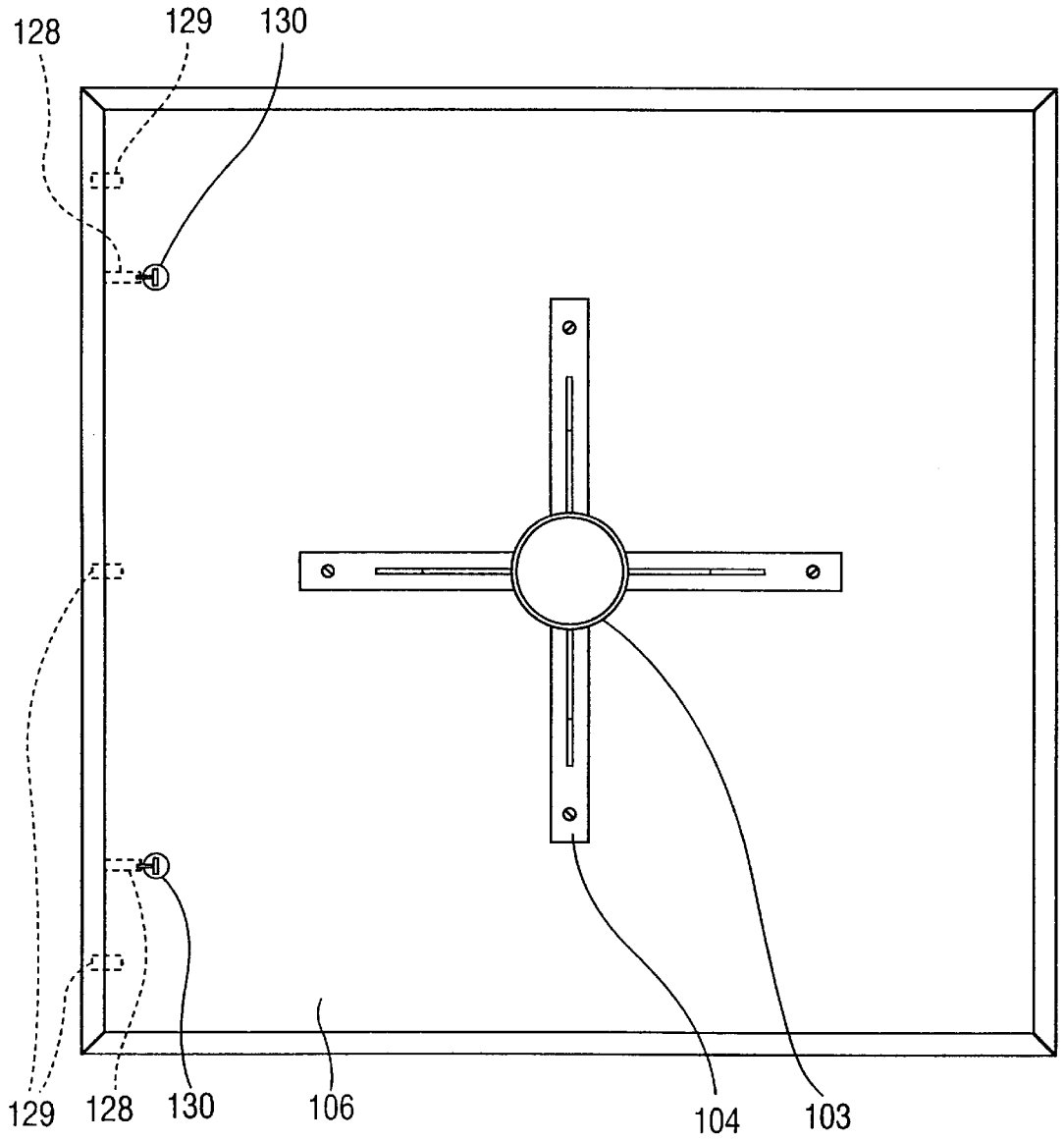
FIG. 6 is a bottom plan view of a table which is equipped with a second embodiment of the invention.
Figure 7:
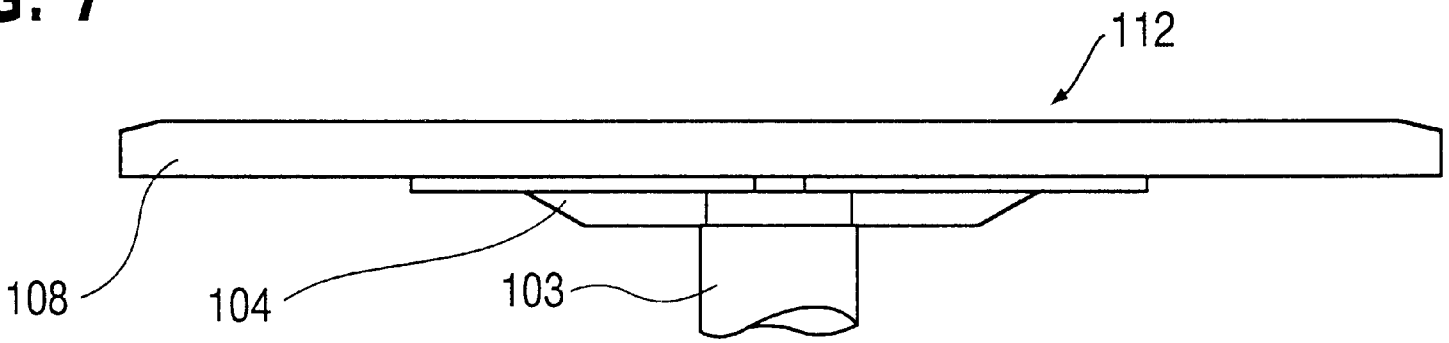
FIG. 7 is a side view of a table shown in FIGS. 5 and 6, with a removable side molding in place.
Figure 8:
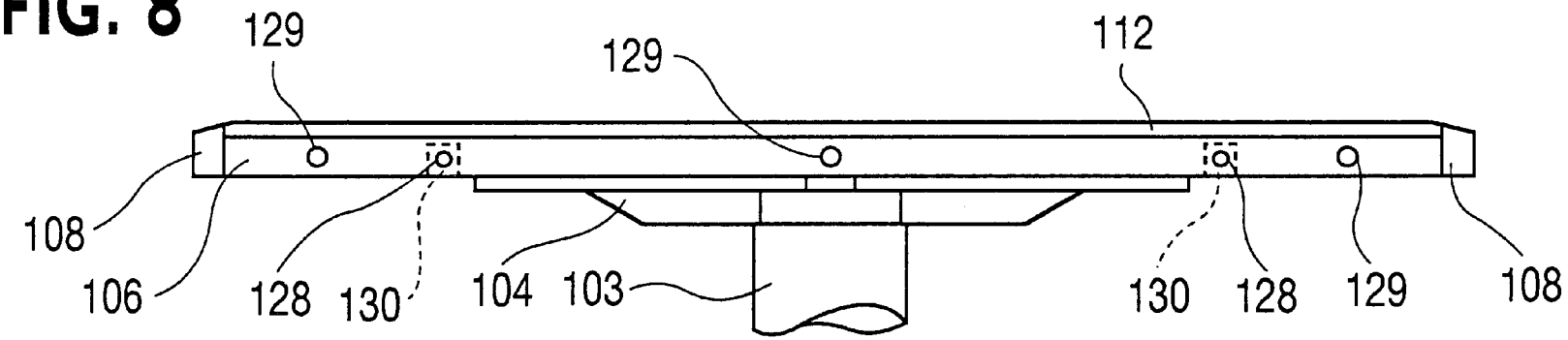
FIG. 8 is side view similar to that of FIG. 7, but showing the removable side molding removed.

FIGS. 2 to 4 show constructional details of a first embodiment of the invention. In accordance with the first embodiment of the invention, the main structure of the table top is formed of an MDF or composite wood base member 106. The base member 106 is rectangular and is surrounded by four edge details or moldings 108. These moldings 108 can be solid lumber finished in clear lacquer or paint, or can alternatively be metal or plastic. Each of the moldings 108 is formed with a retaining recess or groove 110 which extends inwardly into the molding at a level wherein the lower surface of the retaining recess 110 is flush with the upper surface of the wood base 108 of the table proper. A decorative panel 112 is disposed on top of the table top and arranged to have its peripheral edge portions received in the retaining grooves 108 of the edge moldings.

One of the four moldings 108(R) in this embodiment, is, as shown in FIG. 1, detachable from the main body of the table in a manner which permits the decorative panel 112 to be slid out of its retained position and replaced with another.

The removable molding 108(R)is provided with two guide pins 114 which, as illustrated in FIG. 3, are such that at least one acts as a spoiler pin which has a spring loaded pawl 116 which is adapted to engage in a vertically extending bore 118 which intersects with the bore 120 in which the locking pin 114 is received. The pawl 116 is arranged so that it can be pushed back into the body of the pin 114 in response to a special releasing tool being inserted into the vertically extending bore 118. This arrangement is designed to prevent unauthorized removal of the decorative panel 112 and possible unauthorized replacement of the panel 112 with an imitation.

FIG. 4 shows a second security arrangement wherein the panel is provided with holes 122 in the peripheral edge portions which are received in the retaining grooves, into which specially configured grub screws 124 can be inserted to prevent the removal of the panel 112, even if the removable molding 108(R) is taken off. As shown in FIG. 4, the grub screw 124 on the left has been screwed into a locking position wherein it protruded into a hole formed in the decorative panel, while the grub screw 124 shown in the right of the drawing, is shown retracted to a non-locking position. In accordance with the present invention, the grub screws 124 would be formed with heads which would require a special key or screw driver before they could be rotated and screwed or unscrewed. It is also possible to use this type of grub screw in place of the spring loaded pawl 116 shown in FIG. 2. Alternatively, the grub screws 124 can be provided with a spring loaded member which permits the panel 112 to be removed but which will then project up and interfere with the insertion of the next panel unless a special key or screwdriver is used to retract the grub screw to a non-operative position.

It will be appreciated, that while the two different security arrangements which are depicted in FIGS. 3 and 4, can be provided in accordance with the present invention, they are not essential thereto and can be omitted. For example, in the case of wide spread use of the invention, it is possible that a number of restaurant owners (or the like), may accidentally misplace the special tool or tools required to release the edge molding and/or panel and thus be unable to replace the panels when desired. As replacement of the specially designed tools to various locations is apt to be troublesome and time consuming, it is possible that the provision of these securing measures may actually become a liability and thus, their omission can, under certain circumstances, be preferable. The guide pins 114 therefore can be replaced with conventional knock down fittings commonly used in assemble-yourself type of furniture such as the "Minifix 15 Knock Down Fittings" available from HAFELE®.

The interchangeable graphics panel 112 in this embodiment is 3 mm (nominal ⅛") NuGrafix/Vitricor hard coated for wear and tear resistance. Each of those trademarks identify the type of acrylic laminates noted in the patents to Hayman-Chaffey which are identified above.

Figure 9:
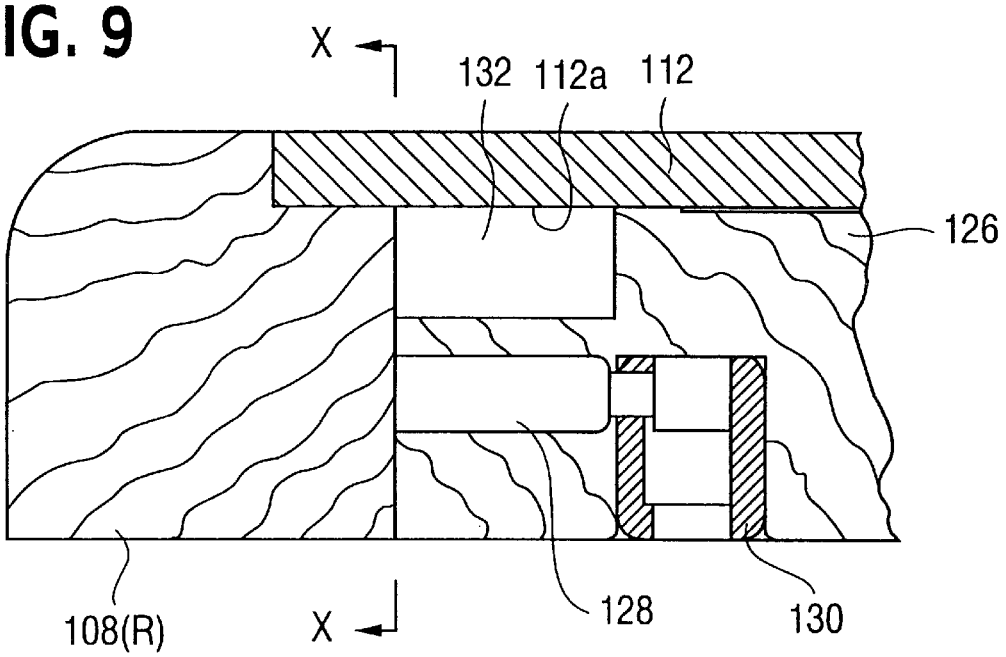
FIG. 9 is a sectional view showing a variant of the second embodiment of the invention wherein recesses are provided to facilitate panel removal.
Figure 10:
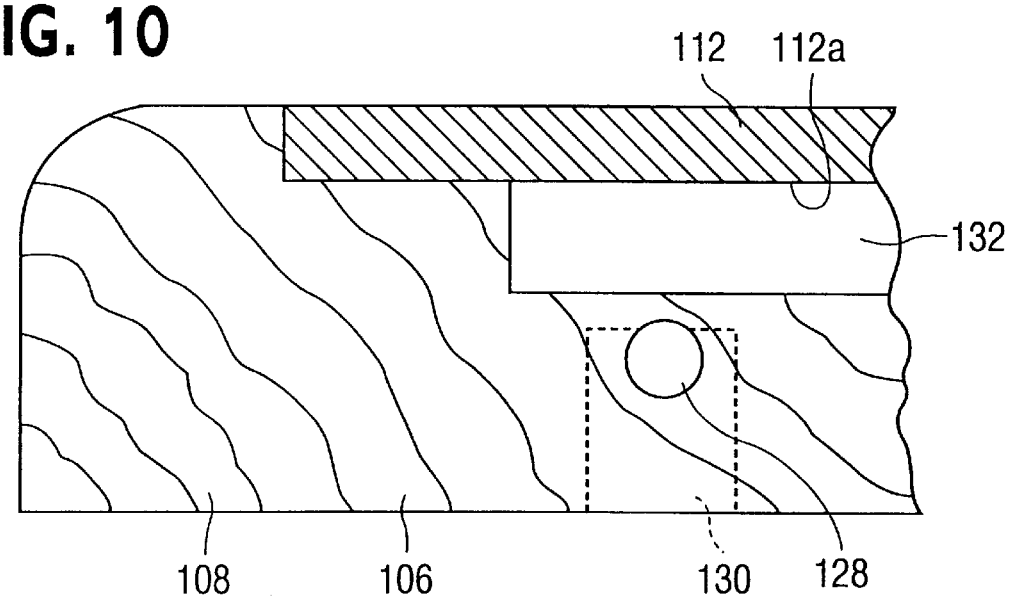
FIG. 10 is a sectional view as taken along section line X—X of FIG. 9.

FIGS. 5 to 10 show a second embodiment of the present invention. In this embodiment, the upper surface of the decorative panel 112 and the upper surface of the edge moldings 108 are arranged, as best seen in FIGS. 9 and 10, to lie flush with one another and thus create a table top which is completely flat and without projections. In this embodiment, the three "fixed" side moldings (108) are formed integrally with the base member 106, and only the removable molding 108(R) is separately configured.

The decorative panel 112 is fastened to the top of the table by way of dual-sided tape 126 which is suitably placed on the lower surface of the panel 112. Experiments conducted during the development of this embodiment revealed that two particular tapes provided particularly good results. These are 3M® products wherein the first is a double-coated tissue paper having a 4 mm thickness and a double coated polyester tape having a thickness of 5 mm. Both of these tapes are 1" wide and come in rolls 36 yards long. These tapes were found to provide the most even adhesion and were found to be easier to use than the thick double-sided foam tapes which vary anywhere between 1/32" and ⅛" thick. As will be readily appreciated, the thickness of the tape will have an effect on the depth to which a recess defined in the table top by the bordering moldings will have to set. Further, the tape must also be both durable and sufficiently strong as to prevent accidental or unintentional detachment of the decorative panel from the table proper even after prolonged use.

In this embodiment, the removable molding 108(R) is connected to the base member 106 by way of conventional stepped pins 128 and rotatable housings or nuts 130 of the above mentioned type. Dowel pins 129 are also provided to improve the stability with which the removable molding 108(R) is mounted to the edge of the base member 106.

An important feature of the second embodiment is the provision of a channel 132 which extends essentially along the entire edge of the base member 106 that is abutted by the removable molding 108(R). When the removable molding is removed, the channel 132 is exposed in a manner which permits the digits (fingers) of an operator's hand, or suitable prying tool, to be inserted and an appropriate amount of force applied to the lower surface 112*a* of the decorative panel 112 to permit the panel 112 to be levered up against the resistance of the adhesive on the dual-sided tape 126. The channel 132 can extend continuously along the edge of the base member 106 or be intermittently formed. A further alternative is to drill hemicylindrical channels in suitable positions along the edge of the base member 106 to allow a person's fingers to be inserted and enable the application of a suitable lifting force.

It will of course be appreciated that the invention is not limited to four sided tables and that the invention may well be applied to round or polygonally configured tables. In the case of round tables it would be necessary for the removable molding to be arcuate in shape and extend about half of the perimeter of the table. The locking pins and/or dowels which extend from this arcuate molding would have to be parallel to facilitate installation. The arrangements necessary with eight sided tables will be self-evident in light of the preceding disclosure.

Figure 11:
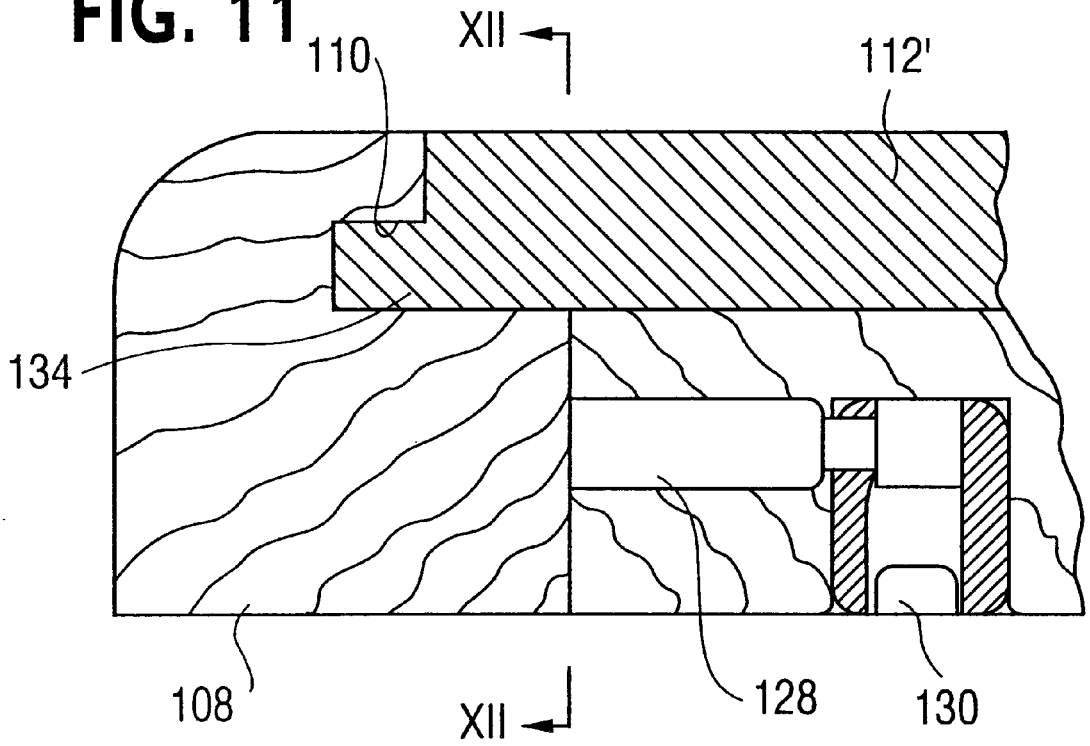
FIG. 11 is a sectional view showing a third embodiment of the invention which features double thickness stepped edge panel.
Figure 12:
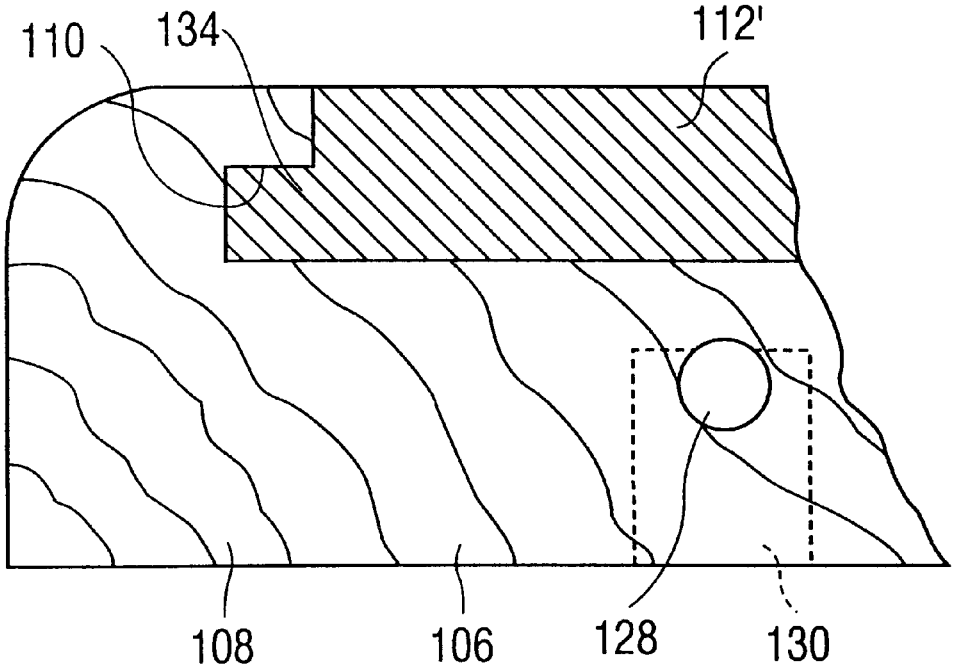
FIG. 12 is a sectional view taken along section line XII—XII of FIG. 11.

FIGS. 11 and 12 show a third embodiment of the invention. In this embodiment the surface of the decorative panel 112' and the edge moldings 108 are flush as in the case of the second embodiment. However, in this case the panel 112' is formed to have a thickness which is essentially twice that used in the previous embodiments and is machined along the edges to form a tongue 134 which is slidably received in retaining grooves.

Figure 13:
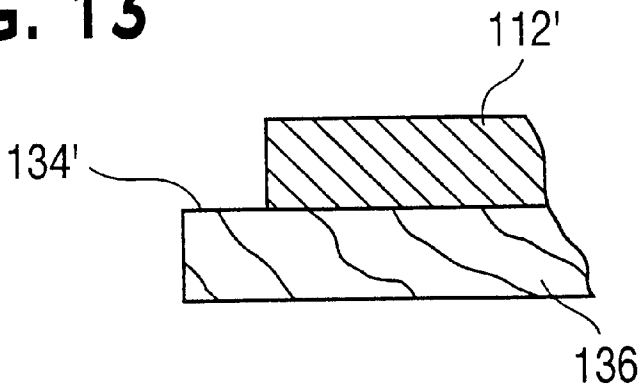
FIG. 13 is a sectional view showing a panel construction wherein the panel is comprised of an upper decorative panel and a lower backing panel.

FIG. 13 shows a panel structure which enables the cost of the arrangement to be reduced. In this arrangement the panel 112" is bonded or otherwise fixed to the upper surface of a backboard 136 formed from a piece of Masonite® or similar smooth surface hardboard. With this arrangement the backboard 136 is larger than the decorative panel 112" and sized so that the projecting portions act as the tongue portions 134' which are received in the retaining grooves 110.

Figure 14:
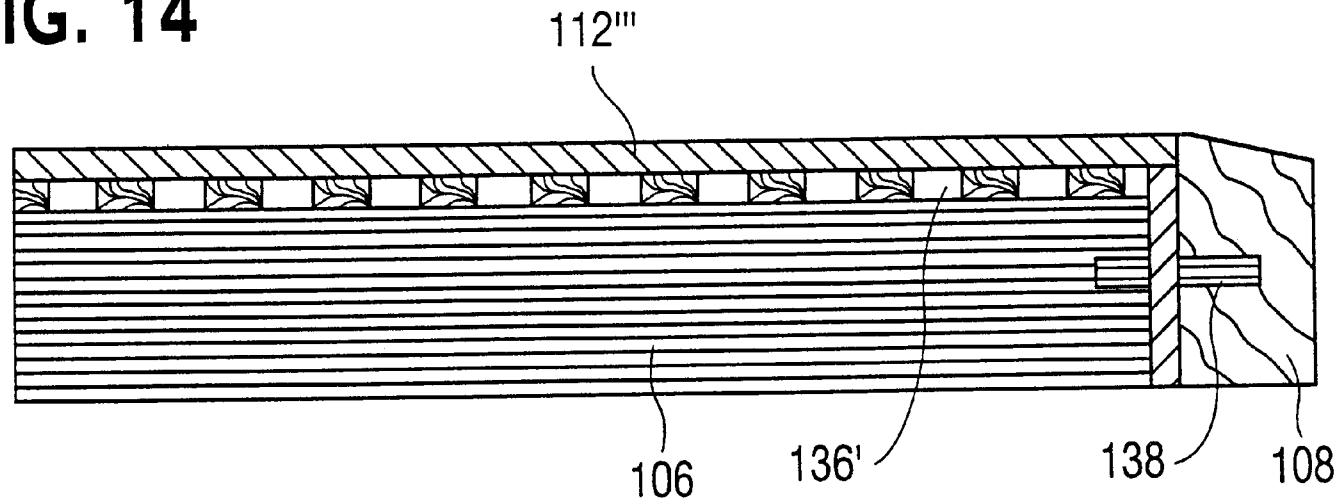
FIG. 14 is a sectional view showing a fourth embodiment of the invention wherein the decorative panel is larger than the lower backing panel and which shows the use of dowel pins to establish a connection between the table top proper and the side edge moldings.

FIG. 14 shows another embodiment of the invention. In this embodiment the panel 112'" is bonded to the upper surface of a piece of hardwood or the like. However, in this instance the panel is larger in area than the backboard 136' and the backboard 136' is fixed to the upper surface of the base member 106 by way of dual sided tape (not shown). In this FIG. 138 denotes a dowel pin which is used to fix/support the molding 108 on the base member 106.

As will be appreciated, the invention has been disclosed with reference to only a limited number of embodiments and variants. However, in light of this disclosure the various changes and modifications which can be made without departing from the scope of the invention, which is limited only by the appended claims, will be self-evident to the person skilled in the art to which this invention pertains.

What is claimed is:

1. A table comprising:

a table top having a recessed portion;

a removable edge molding which is releasably connected to said table top;

a single decorative panel disposed directly on said table top in the recessed portion, and provided as a topmost panel of said table;

attachment means for securing the decorative panel in the recessed portion of the table top in a manner which requires the removable edge molding to be released and removed from the table top before the panel can be separated from an upper surface of said table top and removed from the recessed portion.

2. A table as set forth in claim 1, further comprising fastening means for selectively locking the removable edge molding to the table top.

3. A table as set forth in claim 2, wherein said fastening means includes:

a pin which extends from one of the table top and the removable edge molding;

a first bore formed in the other of the table top and the removable edge molding table top for receiving the pin; and a lock screw which is rotatable to engage the pin and lock the pin in the first bores.

4. A table as set forth in claim 2, further comprising:

a second bore which is formed in one of the table top and the edge molding; and a guide dowel which is fixedly connected with the other of the table top and the edge molding, the guide dowel being receivable by the second bore.

5. A table as set forth in claim 1, wherein said attachment means comprises dual sided tape.

6. A table, comprising:

a table top;

a removable edge molding which is releasably connected to said table top;

a decorative panel disposed on said table top;

attachment means for securing the decorative panel to said table top in a manner that requires the removable edge molding to be released and removed from the table top before the panel can be separated from said table top; and a release facilitating recess that is formed in said table top, and is exposed when said removable edge molding is removed from the table top, and which enables leverage to be applied to a lower surface of the panel, thereby prying said panel away from the upper surface of the table top against a resistant force provided by said attachment means.

7. A table as set forth in claim 6, wherein the release facilitating structure recess is formed in the upper surface of the table top and extends inwardly from an edge of the table top against which said edge molding engages, the recess being so sized and configured to permit a lever or a digit of a hand to be inserted thereinto while the panel is fixed to the upper surface of the table top and apply a lifting bias against the lower surface.

8. A table as set forth in claim 1, wherein said attachment means comprises:

a first panel receiving groove formed in a fixed molding which is fixedly connected to the table top;

a second panel receiving groove formed in the removable edge molding, said first and second panel receiving grooves being arranged to cooperatively retain the panel in position until the removable edge molding is released and removed.

9. A table as set forth in claim 8, wherein said panel has a stepped edge which forms a tongue which extends about at least a portion of the periphery of the panel and which is receivable in the first and second receiving grooves.

10. A table as set forth in claim 9, wherein said panel comprises an upper decorative layer and a lower backing layer, said backing layer being greater in surface area than the upper decorative layer and such as to extend beyond the perimeter of the upper layer to form the stepped edge and tongue.

11. A table as set forth in claim 9, further comprising means for locking said panel onto said table top, said locking means being attached to said table, and being unlockable only in response to the application of a predetermined tool to said locking means.

12. A table, which comprises:

a decorative panel that is disposed on an upper surface of a main table member;

means for securing the panel to the main table member;

a removable member detachably connected to the main table member, said removable member being adapted to, when removed from the main table member, expose a portion of the decorative panel in a manner which facilitates the removal and replacement of the panel with another; and a locking mechansim, for locking said panel onto said table top, said locking mechanism being attached to said table, and being unlockable only in response to the application of a predetermined tool to said locking mechanism.

13. The table according to claim 12, wherein said locking mechanism comprises:

at least one spoiler pin, having a spring loaded pawl, and attached to one of said main table member and said removable member;

a first bore that engages with said spoiler pin; and a second bore that engages with said spring loaded pawl when said locking mechanism is locked.

14. The table according to claim 12, wherein said locking mechanism comprises:

a hole in said decorative panel;

a bore in said main table member, in communication with said at least one hole in said decorative panel; and a grub screw that engages with said hole and said bore when said locking mechanism is locked.

15. The table according to claim 14, wherein said grub screw is biased by a spring member.

16. The table of claim 12, wherein said decorative panel comprises an acrylic laminate material.

17. The table of claim 1, wherein said single decorative panel comprises an acrylic laminate material.

* * * * *